United States Patent [19]

Orr

[11] 4,291,562

[45] Sep. 29, 1981

[54] THREE ROLL TENSION STAND

[76] Inventor: Howard S. Orr, 2080 Outlook Dr., Pittsburgh, Pa. 15241

[21] Appl. No.: 77,310

[22] Filed: Sep. 20, 1979

[51] Int. Cl.[3] ..... B21B 1/28; B21B 39/08

[52] U.S. Cl. ..... 72/205; 72/366; 72/199

[58] Field of Search ..... 72/205, 199, 234, 366

[56] References Cited

U.S. PATENT DOCUMENTS

| | | | |
|---|---|---|---|
| 1,943,005 | 1/1934 | Coryell | 72/205 |
| 2,166,418 | 7/1939 | McBain | 72/205 |
| 2,291,361 | 7/1942 | Walsh | 72/160 |
| 2,316,067 | 4/1943 | Hickman | 72/205 |
| 2,332,796 | 10/1943 | Hume | 72/160 |
| 2,526,296 | 10/1950 | Stone | 72/205 |
| 2,742,949 | 4/1956 | Nilsson | 72/165 |
| 3,238,756 | 3/1966 | Coffin, Jr. | 72/232 |
| 3,253,445 | 5/1966 | Franek | 72/205 X |
| 3,823,593 | 7/1974 | Xydrin et al. | 72/205 |

OTHER PUBLICATIONS

"Shear Rolling, A New Cold Rolling Method", Hollmann & Pawelski, Stahl & Eisen 99 (1979) Nr. 6 at p. 227.

*Primary Examiner*—Milton S. Mehr

*Attorney, Agent, or Firm*—Martin J. Carroll

[57] ABSTRACT

Metal strip is made by heating a workpiece to an elevated temperature, wrapping it around a substantial arc of a first roll, positioning a second roll with respect to the first roll to provide a roll pass therewith at the exit end of the wrap, positioning a third roll with respect to the second roll to provide a second roll pass to give the desired strip thickness with the workpiece engaging a substantial arc of the second roll between the roll passes, the arc of wrap around each of the first and second rolls being less than 90°. The second roll is rotated at a peripheral speed substantially greater than that of the first roll and the third roll is rotated at a peripheral speed at least as great as that of the second roll. A ferrous base hot rolled strip having a width of at least 20 inches, a maximum thickness of 0.04 inches and a length of at least 80 feet is obtainable by this method.

14 Claims, 4 Drawing Figures

THREE ROLL TENSION STAND

This invention relates to the rolling of metal strip and more particularly to the rolling of strip at elevated temperatures while subjecting it to both tension and compressive stresses. Strip may be rolled cold, warm or hot. In the case of ferrous strip such as steel, the cold rolled strip may leave the mill at 600° F. while it is fed at or close to ambient temperature. In hot rolling the steel workpiece, generally in the form of a slab, is normally heated to a temperature of about 2200° F. The actual hot rolling temperature is generally above 1300° F., the lower critical temperature of plain carbon steel, but may go as low as 1200° F.

In warm rolling the workpiece is rolled at a temperature below the hot rolling temperature but above the finishing cold rolling temperature. This temperature must be sufficient to relieve at least some of the strain as the strip cools. With other metals the hot and cold rolling temperature will differ from those of steel, but in general hot rolling is performed with the metal in such plastic state that it is readily deformable so that it lessens the power required for rolling, and warm rolling is performed at elevated temperature below that of hot rolling to increase the mechanical properties of the metal. While the present invention is particularly advantageous for hot rolling it is also suitable for warm rolling. Obviously there are great difference in the problems involved in hot and warm rolling as compared to cold rolling which in general practice is limited to rolling strip already reduced by hot and/or warm rolling. Strip as used herein relates to flat products having a substantially greater width than thickness and having either a smooth surface or a surface with a design thereon. In general the width will be at least 20 inches.

Cold rolled strip has been made using both tension and compression with or without bending stresses. The best art of which I have knowledge is an article in Stahl and Eisen 99 (1979) Nr 6 at page 227 entitled "Shear rolling, a new cold rolling method" by Hollmann and Pawelski and the following U.S. patents:

Coryell Pat No. 1,943,005 dated Jan. 9, 1934
McBain Pat No. 2,166,418 dated July 18, 1939
Walsh Pat No. 2,291,361 dated July 28, 1942
Hickman Pat No. 2,316,067 dated Apr. 6, 1943
Hume Pat No. 2,332,796 dated Oct. 26, 1943
Stone Pat No. 2,526,296 dated Oct. 17, 1950
Nelsson Pat No. 2,742,949 dated Apr. 24, 1956
Coffin Pat No. 3,238,756 dated Mar. 8, 1966

While the methods and apparatus of the prior art are suitable for their intended purposes which is to cold reduce the strip or in some instances to merely strecher level it, they cannot be used to roll strip at elevated temperatures for various reasons. It would be impossible or at least impracticable to obtain tension on a free end workpiece, no substantial tension could be obtained without excessive necking or narrowing of strip width, and/or excessive decrease in temperature of the workpiece during rolling would occur.

Most metal strip, especially steel strip, is rolled in semicontinuous or continuous hot strip mills which are expensive, high production mills which must operate at high speeds. In many countries the demand for steel strip is not sufficient to warrant building such a line. So called steel "mini-mills" have been increasing in the United States and other countries. Any such sheet or strip producing facilities are very inefficient. In addition to the high capital cost of continuous and semi-continuous mills, especially those rolling "hard to roll" metals such as steel they have the disadvantage that they cannot reduce the strip thickness to that desired. For example, steel strip reduction is generally limited to a minimum thickness of 0.060 in. while with special controls and high cost it is possible to obtain a thickness as low as 0.048 in. In small lengths and widths and with special equipment and great expense somewhat thinner strip may be hot rolled. As a result of the above situation more expensive cold rolled strip is used in the production of products such as barrels or containers which do not require the better finish of cold rolled strip, but do require the lighter weight of the thinner strip.

It is therefore an object of my invention to provide a method and apparatus for rolling strip in long lengths and wide widths which require substantially less investment than present methods and apparatus.

Another object is to provide such a method and apparatus which are economical for the relatively low production of "mini-mills".

A further object is to provide such a method and apparatus which are suitable for rolling "hard to roll" metals.

Still another object is to provide such a method and apparatus which can hot roll strip to a thinner gage than possible with present equipment.

A still further object is to provide a ferrous hot rolled wide strip in lengths of at least 80 feet and a maximum thickness of 0.040 in.

These and other objects will be more apparent after referring to the following specification and attached drawings in which.

Figure 1:
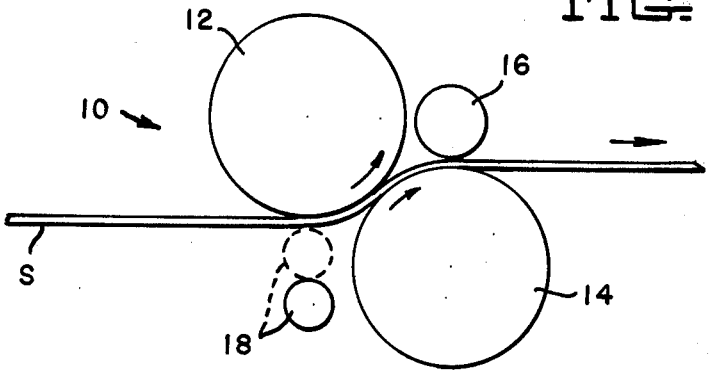
FIG. 1 is a schematic view of the three roll tension stand of my invention.

Referring more particularly to the drawings, reference numeral 2 indicates the first finishing stand of a hot strip mill having work rolls 4 and back-up rolls 6. The rolls 4 are driven in a conventional manner from motor 8. It will be understood that other conventional roll stands are provided before stand 2 and that a conventional heated slab is reduced by such rolls to provide a heated strip S entering roll stand 10. It will be further understood that my invention is not limited to any particular means for reducing the slab to the thickness of the strip entering stand 10. In all cases it is preferred that the strip be kept taut between the three roll stand and the stands on the entry and exit ends thereof.

Figure 4:
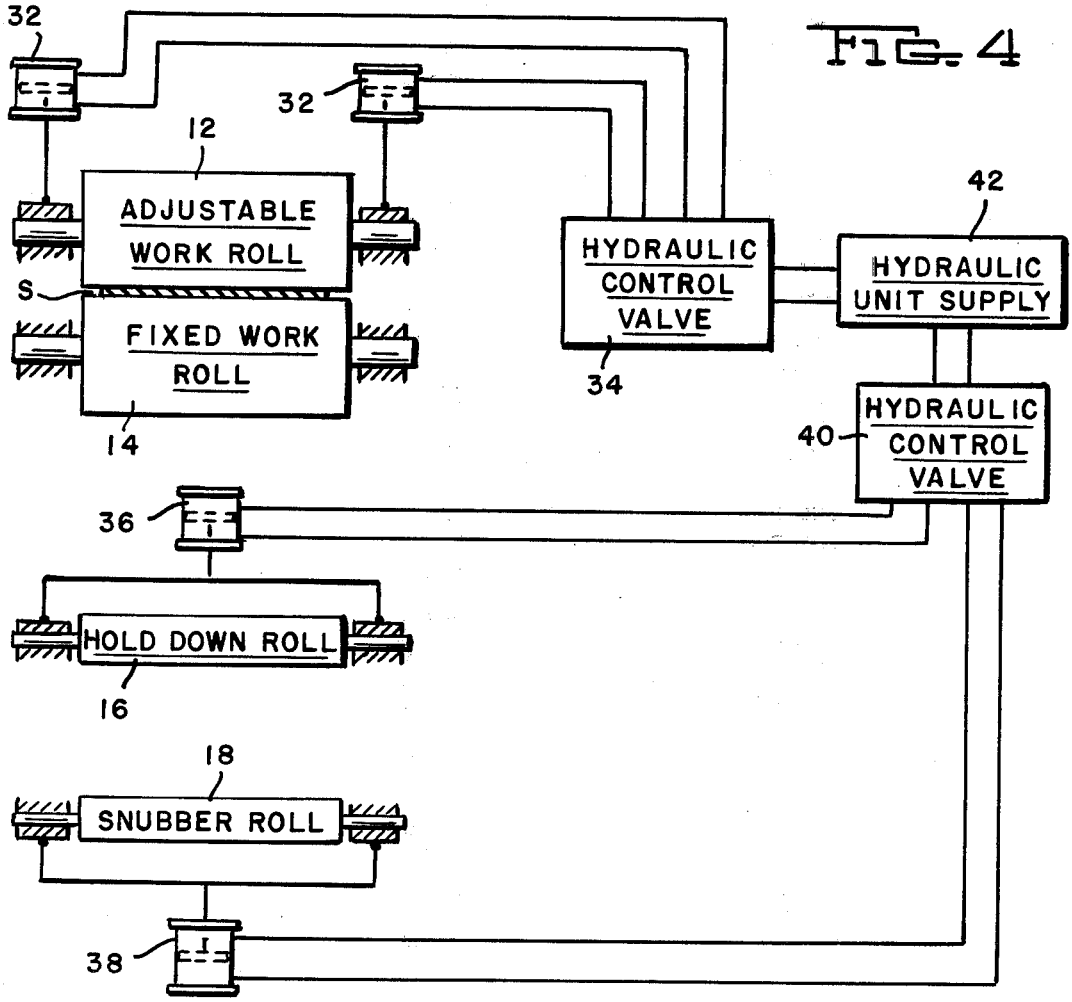
FIG. 4 is a schematic view of the hydraulic system for positioning the rolls of the three roll stand.
Figure 3:
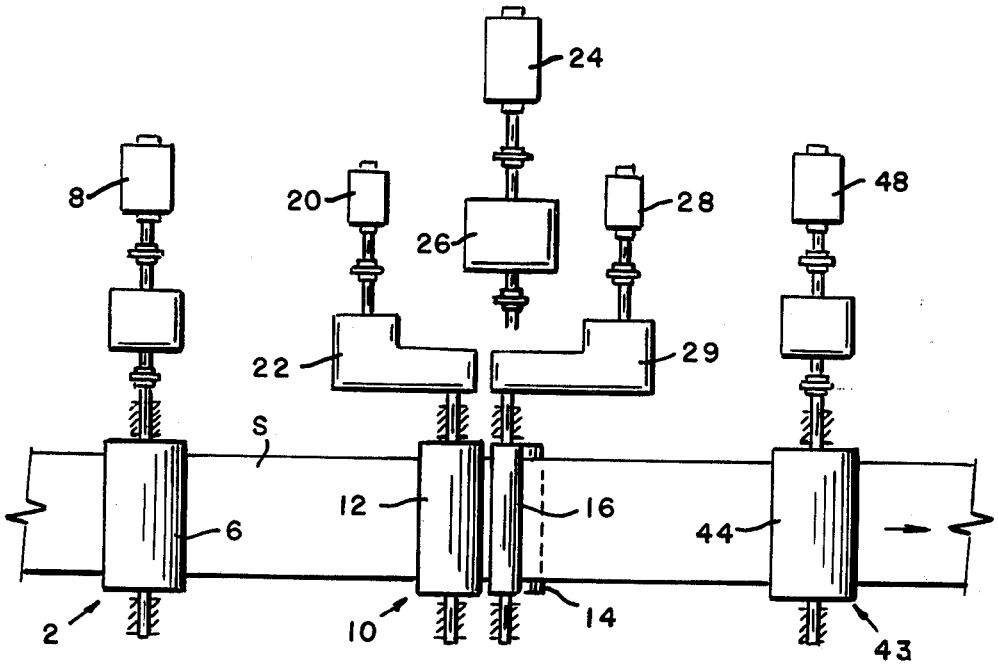
FIG. 3 is a plan view of the stands of FIG. 2.

Roll stand 10 of my invention includes a first roll 12, a second roll 14, a third roll 16, and a pinch roll 18. Roll 12 is driven from motor 20 through a gear reducer 22; roll 14 is driven from motor 24 through a gear reducer 26; and roll 16 is driven from motor 28 through gear reducer 29. As shown in FIG. 4, roll 14 is held in fixed position and roll 12 is movable toward and away therefrom by means of hydraulic motors 32 operable by control valve 34. Rolls 16 and 18 are movable toward and away from rolls 14 and 12, respectively, by means of hydraulic motors 36 and 38 operable by control valve 40. Fluid under pressure is supplied from hydraulic unit supply 42.

Roll 14 is the principal driver and is preferably of larger diameter than conventional hot strip work rolls; for example, 40 to 42 inches. Roll 16 is the auxiliary driver and, for manufacturing reasons, is made substantially smaller than roll 14. The preferred diameter of roll 16 is approximately 40% that of roll 14. However, functionally roll 16 may be as large or even larger than roll 14. Roll 12 is the generator that provides back tension to the strip S in the roll bite. The diameter of roll 12 may vary greatly, but preferably is kept large to provide better grip. Rolls 12 and 14 may be provided with back-up rolls, if required for very wide strip widths.

The final finishing stand 43 is located on the exit side of roll stand 10 and includes work rolls 44 and back-up rolls 46. Rolls 44 are driven in a conventional manner from motor 48.

In operation, pinch roll 18 is positioned at its inner position adjacent roll 12 as shown in broken lines in FIG. 1 so that it will support and direct the leading end of strip S leaving roll stand 2 against smaller roll 12. Roll 16 is moved inwardly to provide a roll gap with roll 14 to give the desired thickness of strip leaving stand 10. The peripheral speed of roll 12 is slightly faster (perferably about ½%) than the speed of strip S leaving stand 2. After threading, the peripheral speed of roll 14 is set dependent upon the elongation desired. For example, if an elongation of 2.0 is desired, the speed of roll 14 will be approximately twice that of roll 12. If an elongation of 3.0 is desired, the speed of roll 14 will be approximately three times that of roll 12. In other words, the peripheral speed of roll 14 equals the peripheral speed of roll 12 times the ratio of entry gage to delivery gage of stand 10. The peripheral speed of roll 16 must be at least as great as that of roll 14 to prevent build up of strip between the roll passes. For practical purposes the peripheral speed of roll 16 is kept slightly greater (preferably about ½%) than that of roll 14. When threading stand 10, roll 12 is preferably rotated somewhat faster than the speed of strip S leaving stand 2, but is slowed down to the speed set forth above when the head end of the strip is gripped between rolls 14 and 16. At this time, pinch roll 18 is preferably retracted to the full line position of FIG. 1. There must be substantial arc of contact between strip S and roll 12 to give the necessary back tension on the strip at the roll bite. For most materials and roll sizes, the arc of contact will be at least 10°. Of course, larger diameter rolls will require fewer degrees of arc for the same grip. It is greatly preferred that the arc be no greater than 60° and in all cases must be less than 90°. From stand 10 the strip S is directed into finishing stand 43.

Figure 2:
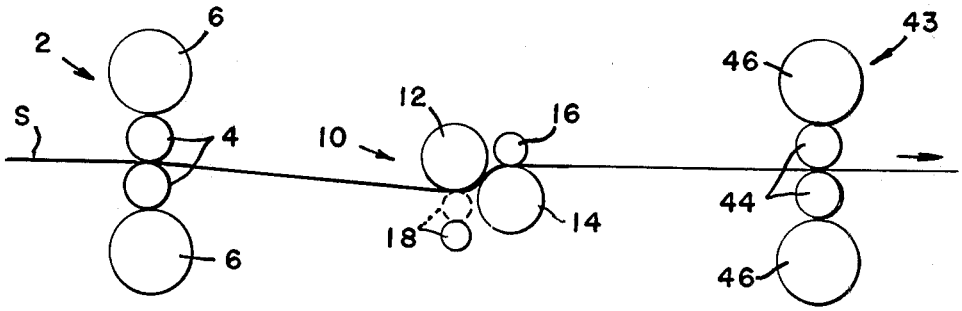
FIG. 2 is an elevation of the three roll stand located between the first and last finishing stands of a typical wide hot strip mill.

For the rolling of very light hot strip product, it may be desired to use two 3-roll stands 10 in tandem arrangement in place of the one shown in FIG. 2.

In rolling strip having a design on one or both surfaces, rolls 12 and/or 14 will have the peripheral surface provided with the required design. The use of a design also has the advantage that the grip or friction between the roll and strip is increased. Since it is generally desireable to have as little wrap as possible in order to keep the heat loss from the strip to a minimum, thus enabling a greater reduction, a design may be used merely to give better grip with the design being removed in roll stand 43. It will be understood that the amount of wrap will be selected dependent upon the material being rolled, the temperature of the strip and the tension required to obtain the desired reduction. A ferrous strip may be hot rolled to lengths of 80 feet, and much longer, in widths of 20 inches to 72 inches or wider to a thickness of 0.040 in. or thinner with applicant's method and apparatus. In such cases the slab will have been rolled to a thickness of 0.500 in. or less by conventional means. By using two 3-roll stands in tandem very light gage strip may be rolled.

It will be understood that my 3-roll stand may be used in combination with other types of roll stands than shown.

While one embodiment is shown and described it will be understood that other adaptations and embodiments may be made within the scope of the following claims.

I claim:

1. The method of reducing a metal workpiece at elevated temperatures to produce a strip like product which comprises feeding said workpiece to a first roll and wrapping it around a substantial arc thereof, positioning a second roll with respect to said first roll to provide a roll pass therewith at the exit end of said wrap around said first roll, positioning a third roll with respect to said second roll to provide a second roll pass to give the desired thickness of said strip like product, said workpiece engaging the surface of said second roll between said roll passes, the arc of wrap around each of said first and second rolls being less than 90°, rotating said second roll at a peripheral speed substantially greater than that of said first roll, and rotating said third roll at a peripheral speed at least as great as that of said second roll.

2. The method of claim 1 in which said second roll is operated at a peripheral speed equal to that of the first roll times the ratio of entry gage to delivery gage.

3. The method of claim 1 in which a pinch roll is positioned adjacent said first roll to direct the leading end of said workpiece against said first roll.

4. The method of claim 3 in which said second roll is operated at a peripheral speed equal to that of the first roll times the ratio of entry gage to delivery gage.

5. The method of claim 2 in which the arc of contact of said workpiece about said first roll is between 10° and 60°.

6. The method of claim 5 is which said workpiece is a ferrous base metal and is reduced to a maximum thickness of 0.040 in., said strip like product having a width of at least 20 inches and a length of at least 80 feet.

7. The method of claim 1 in which said third roll is of substantially smaller diameter than said second roll.

8. The method of claim 1 in which said third roll is rotated at a peripheral speed slightly greater than that of said second roll.

9. Apparatus for rolling a metal workpiece at elevated temperatures to produce a strip like product which comprises a three-roll stand, the first and second rolls of said stand being positioned adjacent one another to provide a first roll pass, the second and third rolls of said stand being positioned adjacent one another to provide a second roll pass, means for directing said workpiece to said first roll such that it wraps around a substantial arc thereof before it enters said first roll pass, said workpiece passing around said second roll between said roll passes, means for rotating said first roll at a peripheral speed slightly greater than the entry speed of said workpiece, means for rotating said second roll, means for controlling said rotating means of said second roll to cause it to rotate at a substantially greater peripheral speed than that of said first roll, and means for rotating said third roll at a peripheral speed at least as great as that of said second roll, said rolls being so positioned that the maximum arc of wrap around said each of said first and second rolls is 90°.

10. Apparatus according to claim 9 including means for moving said first and second rolls toward and away from one another to vary said first roll pass, and means for moving said second and third rolls toward and away from one another to vary said second roll pass.

11. Apparatus according to claim 10 in which said means for directing said workpiece to said first roll includes a pinch roll on the entry side of said three-roll stand, and means for moving said pinch roll toward and away from said first roll.

12. Apparatus according to claim 10 including an entry roll stand on the entry side of said three-roll stand through which said workpiece passes before entering said three-roll stand, and a finishing roll stand on the exit side of said three-roll side for receiving the workpiece leaving said three-roll stand.

13. Apparatus according to claim 12 in which at least one of said first and second rolls has a pattern on the peripheral surface thereof.

14. Apparatus according to claim 9 in which said rolls are so positioned that the arc of wrap around each of said first and second rolls is between 10° and 60°.

* * * * *